US006840400B2

(12) United States Patent
Park

(10) Patent No.: US 6,840,400 B2
(45) Date of Patent: Jan. 11, 2005

(54) MEDIA DISPENSER MODULE AND MEDIA DISPENSER APPARATUS HAVING THE SAME

(75) Inventor: Eung-Min Park, Seoul (KR)

(73) Assignee: LG N-Sys Inc., Seoul (KR)

( * ) Notice: Subject to any disclaimer, the term of this patent is extended or adjusted under 35 U.S.C. 154(b) by 57 days.

(21) Appl. No.: 10/319,628

(22) Filed: Dec. 16, 2002

(65) Prior Publication Data

US 2003/0111478 A1 Jun. 19, 2003

(30) Foreign Application Priority Data

Dec. 17, 2001 (KR) ..... 10-2001-0080282

(51) Int. Cl.[7] ..... G07F 11/00
(52) U.S. Cl. ..... 221/12; 221/21
(58) Field of Search ..... 221/3, 9, 13, 12, 221/21, 191, 194, 195, 129; 49/73.1

(56) References Cited

U.S. PATENT DOCUMENTS 4,340,150 A * 7/1982 Guibord et al. ..... 221/21

* cited by examiner

*Primary Examiner*—Kenneth Noland
(74) *Attorney, Agent, or Firm*—Birch, Stewart, Kolasch & Birch, LLP

(57) ABSTRACT

A media dispenser module includes: a casing mounted in a mounting unit of a media dispenser apparatus and having an opening accessible from outside and a door for opening and closing the opening; a media mounting unit installed inside the casing so that media is dropped from a first position where the media is maintained in a mounting state and rotated to a second position where the media is retrieved into a media retrieval box coupled to the casing; a driving unit installed at a side wall of the casing and moving the media mounting unit; a media sensing unit for sensing whether there is media on the media mounting unit; and a controller for controlling opening and closing of the door and the driving unit according to a signal of the media sensing unit.

17 Claims, 7 Drawing Sheets

MEDIA DISPENSER MODULE AND MEDIA DISPENSER APPARATUS HAVING THE SAME

BACKGROUND OF THE INVENTION

1. Field of the Invention

The present invention relates to a media dispenser apparatus.

2. Description of the Background Art

Generally, a media dispenser apparatus such as an automated teller machine (ATM) or a cash dispenser (CD) is a system installed in an area where many people pass by such as a bank, a convenience store (CVS) or a subway station. The ATM/CD allows a user to withdraw cash with a simple operation.

When the user puts a card or a bankbook into an inlet (in some cases, the user inputs required information using an operator panel or using a portable communication device such as a mobile phone) and follows procedures using the operator buttons according to the instructions shown on a display device on a front surface, then media such as cash or a check and a specification sheet are withdrawn according to the procedures. Generally, the specification sheet is withdrawn through a specification sheet outlet, and the media is provided through a media dispenser module (i.e., a customer access module) on the front surface.

If the media dispenser apparatus is malfunctioned in a state wherein there is media in the media dispenser module, it shouldn't be opened outwardly. Especially, if the user inadvertently fails to draw out the media collected inside the media dispenser module, the door is automatically closed and an error is generated to call a manager when a pre-set time elapses (generally, 3 minutes and 30 seconds).

Then, when such an error is generated due to the remaining media, the media dispenser apparatus should be re-started by the manager's manipulation. That is, a manager should be in standby to manage the apparatus, which runs counter to the automation. In addition, the apparatus is in an idle state until the apparatus manager reaches, causing a problem of degradation of the rate of operation.

SUMMARY OF THE INVENTION

Therefore, an object of the present invention is to provide a media dispenser module and a media dispenser apparatus containing the same, that is capable of continuously performing a media withdrawal function by retrieving media if a media dispenser apparatus malfunctions in a state where media remains in a media dispenser module, especially if a media dispenser module operates in a state where a user has left media.

To achieve these and other advantages and in accordance with the purpose of the present invention, as embodied and broadly described herein, there is provided a media dispenser module including: a casing mounted in a mounting unit of a media dispenser apparatus and having an opening accessible from outside and a door for opening and closing the opening; a media mounting unit being installed inside the casing and being rotatable from a first position where media is maintained in a mounting state to a second position where the media is dropped and retrieved into a media retrieval box coupled to the casing; a driving unit installed at a side wall of the casing and moving the media mounting unit; a media sensing unit for sensing whether there is media on the media mounting unit; and a controller for controlling opening and closing of the door and the driving unit according to a signal of the media sensing unit.

To achieve the above objects, there is also provided a media dispenser module including: a mounting unit; and a media dispenser module having a casing mounted in a mounting unit of a media dispenser apparatus and having an opening accessible from outside and a door for opening and closing the opening; a media mounting unit installed inside the casing so that media is dropped from a first position where the media is maintained in a mounting state and rotated to a second position where the media is retrieved into a media retrieval box coupled to the casing; a driving unit installed at a side wall of the casing and moving the media mounting unit; a media sensing unit for sensing whether there is media on the media mounting unit; and a controller for controlling opening and closing of the door and the driving unit according to a signal of the media sensing unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
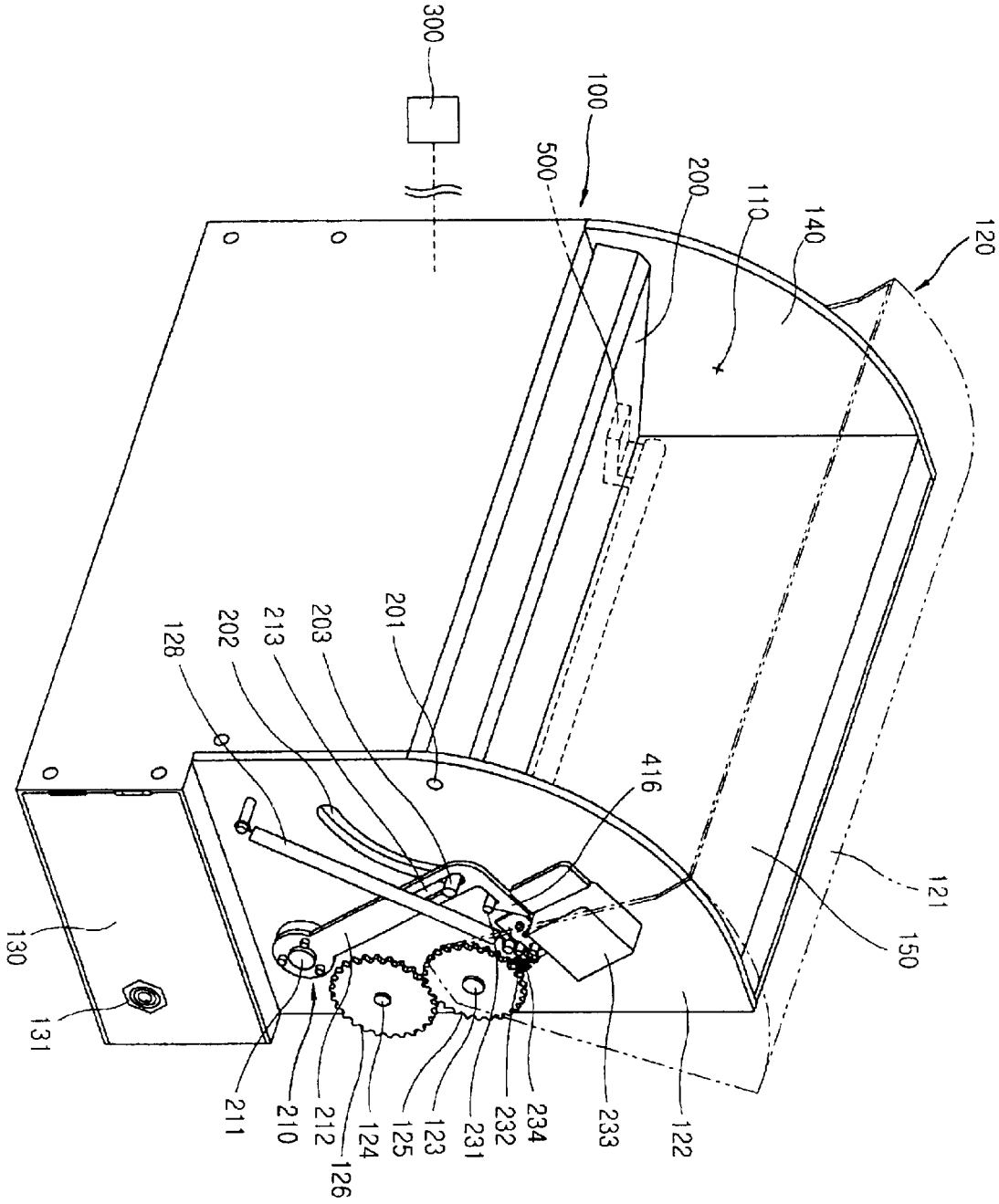
FIG. 1 is a perspective view showing the construction of the media dispenser module in accordance with the present invention.

Reference will now be made in detail to the preferred embodiments of the present invention, examples of which are illustrated in the accompanying drawings.

As shown in FIGS. 1 to 4, a media dispenser module of the present invention includes: a casing 100 mounted in a mounting unit (not shown) of a media dispenser apparatus and having an opening 110 accessible from outside and a door 120 for opening and closing the opening 110; a media mounting unit 200 installed inside the casing 100 and rotatable from a first position where the media is maintained in a mounting state to a second position where the media is dropped and retrieved into a media retrieval box 130 coupled to the casing 100; a driving unit 210 installed at side of the casing 100 and moving the media mounting unit 200; a media sensing unit 220 for sensing whether there is media on the media mounting unit 200; and a controller 300 for controlling opening and closing of the door 120 and the driving unit 210 according to a signal of the media sensing unit 220.

The casing 100 includes a pair of side walls 140 and a rear wall 150 connecting the side walls 140, and a housing (not shown) is provided in the vicinity of the casing 100 to cover the portion except for the opening 110 (to be described) to prevent access to internal parts from outside.

Figure 2:
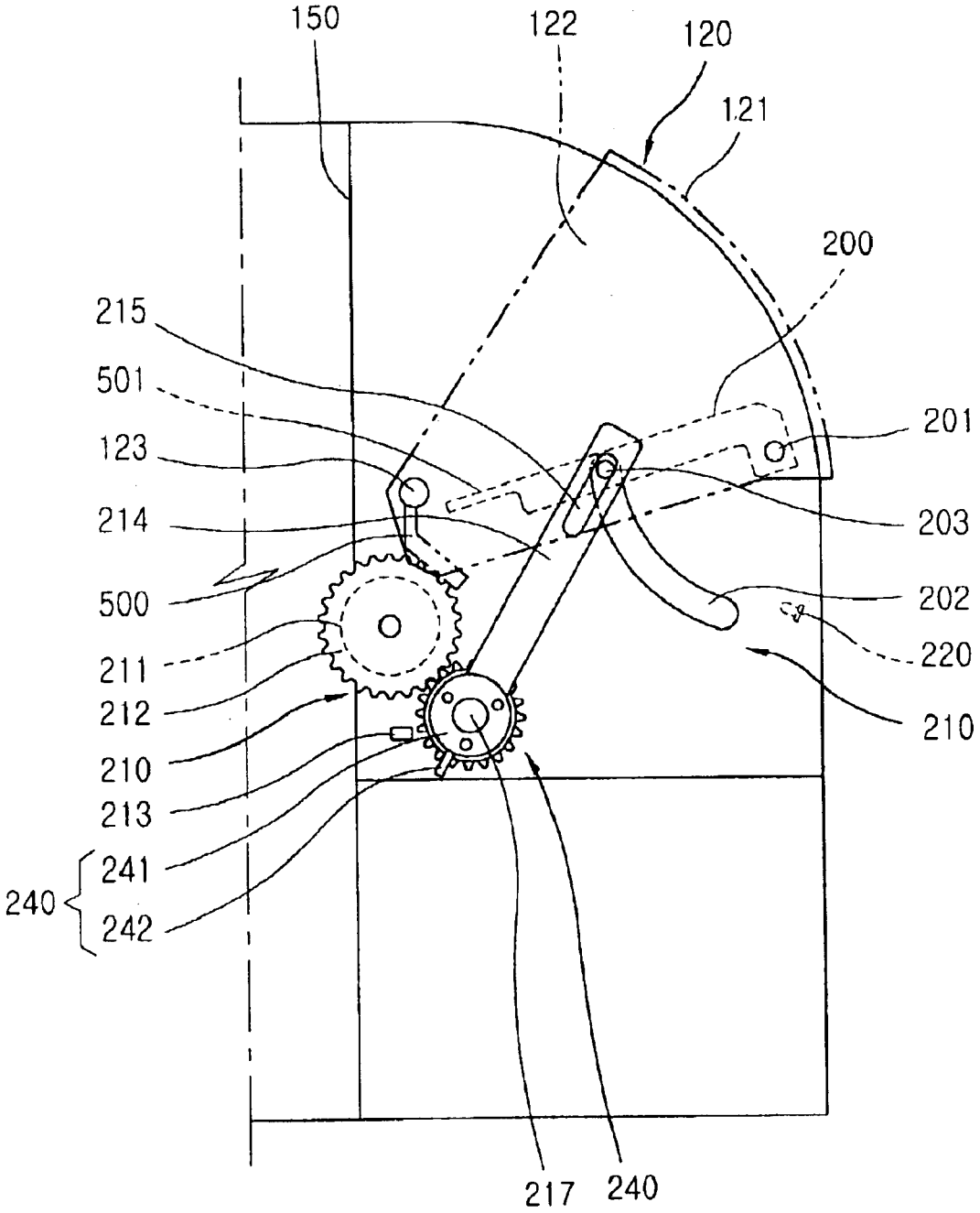
FIG. 2 is a view showing the left side of the media dispenser module of FIG. 1.
Figure 3:
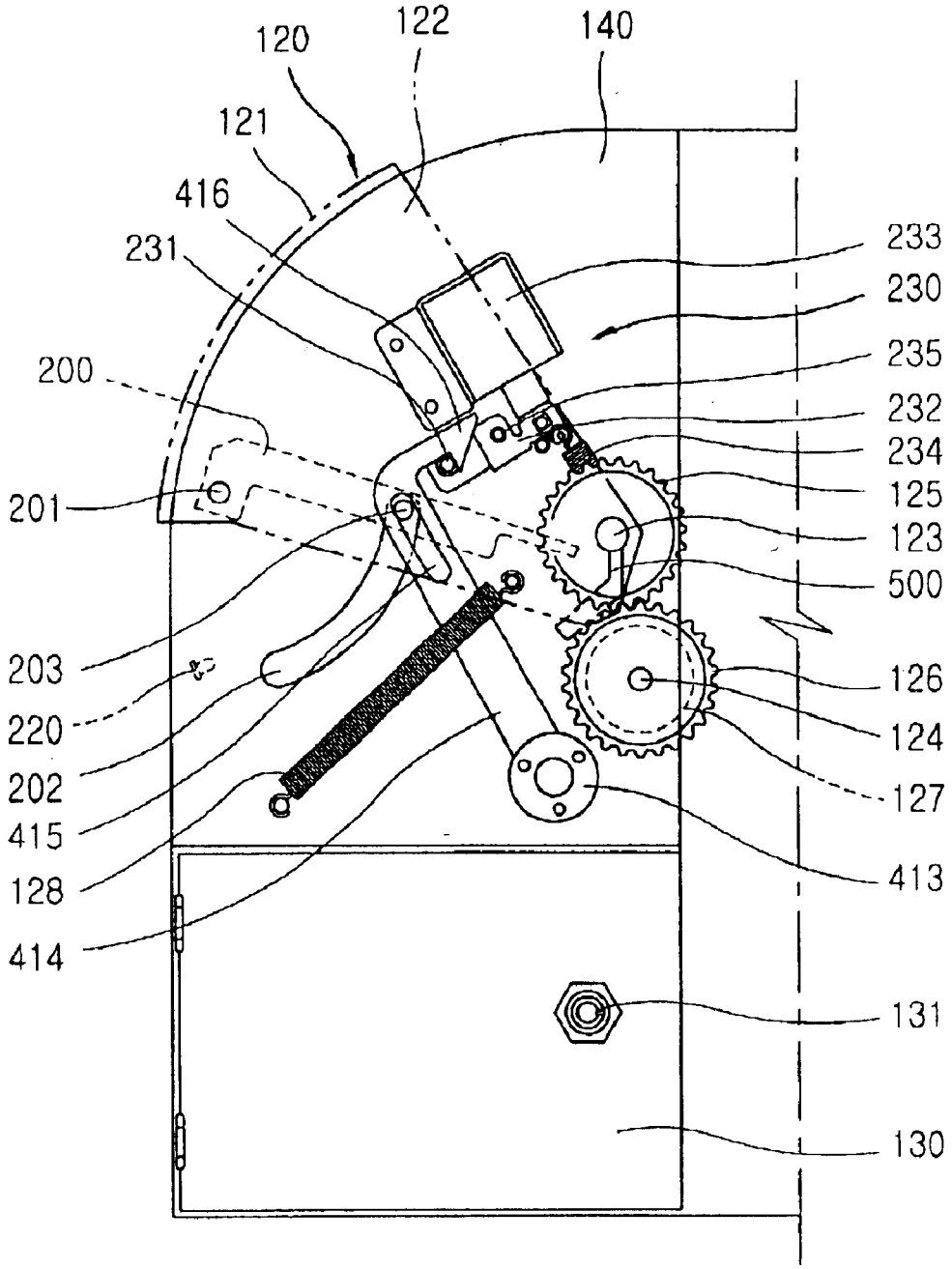
FIG. 3 is a view showing the right side of the media dispenser module of FIG. 1.

As shown in FIGS. 1 to 3, a media retrieval box 130 is installed below the casing 100 to retrieve the media (M) dropped from the media mounting unit 200, and has a locking device 131 to prevent an access from outside.

The media sensing unit 220 is installed at a suitable position inside the casing 100 and checks whether there is media on the media mounting unit 200.

The door 120 includes an opening and closing unit 121 for opening and closing the opening 110 and a pair of side portions 122 extending from each end of the opening and closing unit 121 and rotatably hinged-connected to the outer side of the side wall 140 of the casing 100.

The opening and closing unit 121 opens/closes the opening 110 by being rotated upwardly or downwardly according to rotation of the side portion 122. In the embodiment of the present invention, the opening and closing unit 121 is moved upwardly to open the opening 110.

As shown in FIGS. 1 to 3, the side portion 122 is coupled to a door rotational shaft 123 fixedly installed at an outer side of the side wall 140 of the casing 100, and a rotational gear 125 in mesh with a drive gear 126 coupled to a shaft 124 of a rotational motor 127 is axially coupled to the door rotational shaft 123. Accordingly, the door 120 opens and closes the opening 110 while being rotated by the rotational motor 127.

Meanwhile, one end of an elastic member 128 is fixed to the side portion 122 of the door 120 to restore the door 120 to a closing position, and the other end thereof is fixedly installed at an outer side of the side wall 140 of the casing 100.

Both ends of the media mounting unit 200 are coupled rotatably by a hinge shaft 201 at an inner side of the side wall 140 of the casing 100 in the vicinity of the front side of the casing 100. A guide slot 202 is formed at the side wall 140 of the casing 100, and a guide pin 203 coupled to the both ends of the media mounting unit 200 is inserted into the guide slot 202 to move along therein.

The guide slot 202 is formed as an arc centering around the hinge shaft 201, having one end where the media mounting unit 200 is placed at a first position, and the other end where the media mounting unit 200 is placed at the second position.

The driving unit 210 is installed at an outer side of the left side wall 140 of the casing 100 to move the media mounting unit 200. The driving unit 210 includes a drive motor 211 fixedly installed at the left side wall 140 of the casing 100, a first gear 212 coupled to a shaft of the drive motor 211, a second gear 213 rotated in mesh with the first gear 212, and a link member 214 rotated by being connected to the shaft 217 connected to the second gear 213. The link member 214 includes a slot 215 into which the guide pin 203 is inserted.

A driving unit 410 having the similar construction to that of the driving unit 210 installed at the left side wall 140 is also constructed at the right side wall 140 of the casing 100. The driving unit 410 includes a rotational shaft 413 fixedly installed at the same axial line with the shaft 217 of the second gear 213 and a rotational link 414 connected to the rotational shaft 413 and having an auxiliary slot 415, into which the guide pin 203 is inserted.

Figure 4:
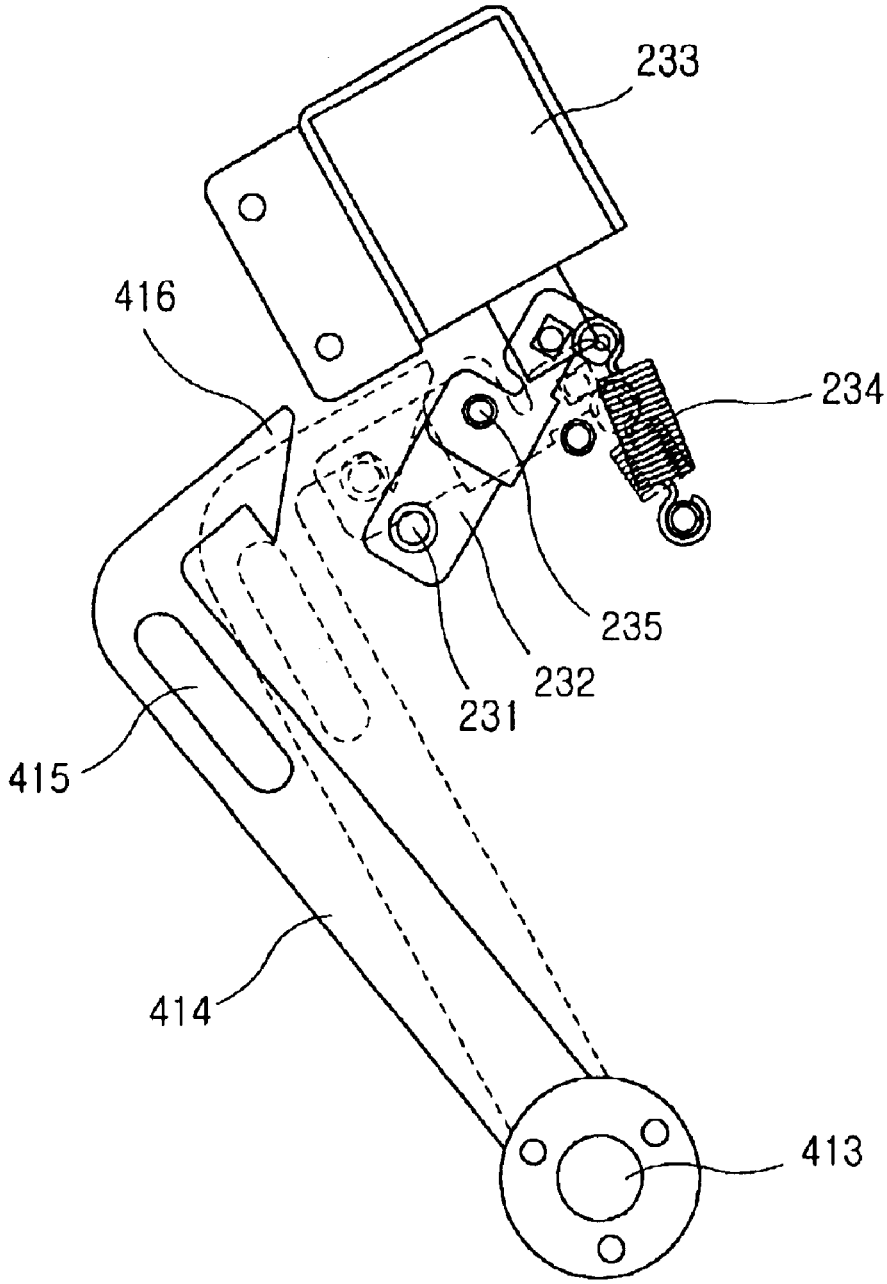
FIG. 4 is a view showing the construction of an engagement releasing unit of FIG. 3.

As shown in FIG. 4, an engaging hook 416 is formed at the end of the rotational link 414 to fix the media mounting unit 200 when the media mounting unit 200 is placed at the first position. An engagement releasing unit 230 is installed at an outer side of the side wall 140 of the casing 100 and has an engaging pin 231 to which the engaging hook 416 is engaged when the media mounting unit 200 is placed at the first position.

The engagement releasing unit 230 includes a rotational member 232 having the engaging pin 231 fixedly installed at its free end and being installed and rotatable centering around a shaft 253 at an outer side of the side wall 140 of the casing 100, a moving unit 233 for moving the rotational member 232 to allow the engaging hook 416 to release engagement at the engaging pin 231, and an elastic member 234 for restoring the rotational member 232 to the engaging position.

The engagement releasing unit 230 releases the engagement of the engaging hook 416 by moving the engaging pin 231 according to an operation signal of the controller 300.

As shown in FIG. 2, a position sensing unit 240 is installed together with the driving unit 210 at the outer side of the left side wall 140 of the casing 100, to sense whether the media mounting unit 200 is placed at the first position or the second position The position sensing unit 240 includes a first protrusion 242 installed at the second gear 213 and a sensing unit 241 installed at the outer side of the side wall 140 of the casing 100 at a portion corresponding to a position when the media mounting unit 200 is placed at the second position, and checks the position of the media mounting unit 200 according to rotation of the second gear 213.

If there is a malfunction signal of the media dispenser apparatus, the controller 300 renders the media sensing unit 220 to sense existence or nonexistence of the media. If it is sensed that there is media in the media mounting unit 200, the controller 300 controls to rotate the media mounting unit 200 from the first position to the second position in a state that the door is closed, in order to retrieve the media on the media mounting unit 200 to the media retrieval box 130.

If a pre-set time elapses in a state that there is media on the media mounting unit 200 and the door 120 is opened, the controller 300 controls such that the door 120 is closed, the media mounting unit 200 is rotated from the first position to the second position and the media on the media mounting unit 200 is retrieved into the media retrieval box 130.

A movement restraining unit 500 supporting the bottom of the media mounting unit 200 placed at the first position is fixedly installed to the door rotational shaft 123 to which the side portion 122 of the door 120, and is rotated together with the door 120, in order to restrain the media mounting unit 200 from moving when the door 120 is in the opening position. When the door is in the closing position, the movement restraining unit 500 does not interfere movement of the media mounting unit 200.

An end portion 501 is formed at a portion supported by the movement restraining unit 500 of the bottom of the media mounting unit 200 as shown in FIGS. 2 and 3.

The operation of the media dispenser module and the media dispenser apparatus having the same constructed as described above will now be explained in detail.

The media dispenser module performs a function of the media dispenser apparatus while it is mounted in the mounting unit of the media dispenser apparatus.

That is, a user injects a card/bankbook into a slot (according to circumstances, the user may input necessary information with an operation plate or by using a mobile communication device such as a communication-available mobile phone), and proceeds with a desired procedure while manipulating manipulation buttons according to guidance displayed on a display device provided on the front surface. Then, according to the procedure, media such as a bill or a check and specifications are withdrawn; the specification is withdrawn through a specification withdrawal slot while the media is provided through a media dispenser module, a customer access module, provided at the front surface.

Figure 5:
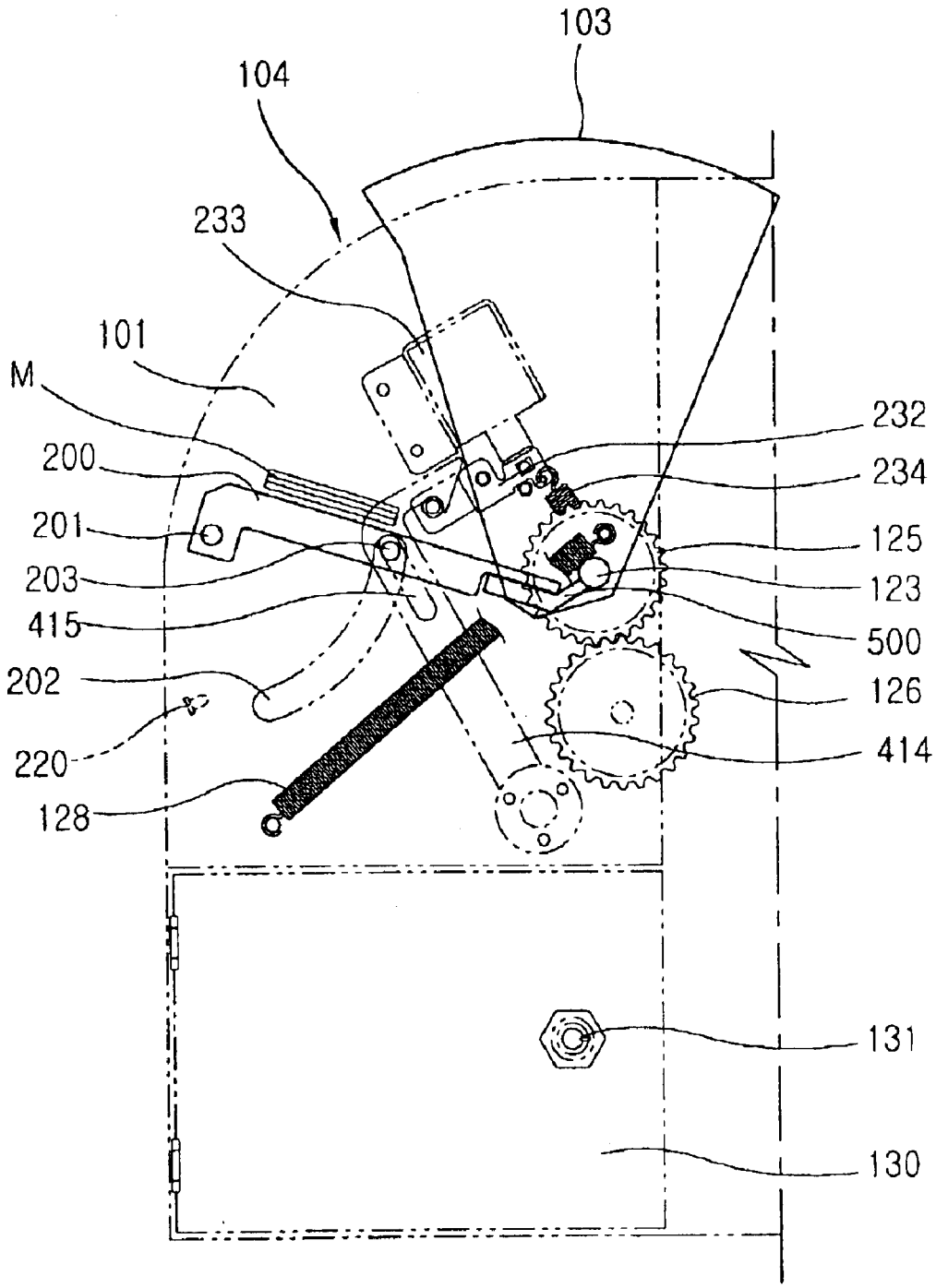
FIG. 5 is a view showing a state wherein a door of the media dispenser module of FIG. 1 is opened.

The media requested by the user is collected on the media mounting unit 200 of the media dispenser module, and after the media is discharged as many as requested, the door 120 is rotated upwardly and opened as shown in FIG. 5.

Then, the user receives the media through the opening 110 of the media dispenser module. At this time, the user may take out the media in the media retrieval box 130 by forcibly rotating the media mounting unit 200, but in such a case, the movement restraining unit 500 prevents the media mounting unit 200 from moving, thereby preventing the media in the media retrieval box 130 from being stolen.

Figure 6:
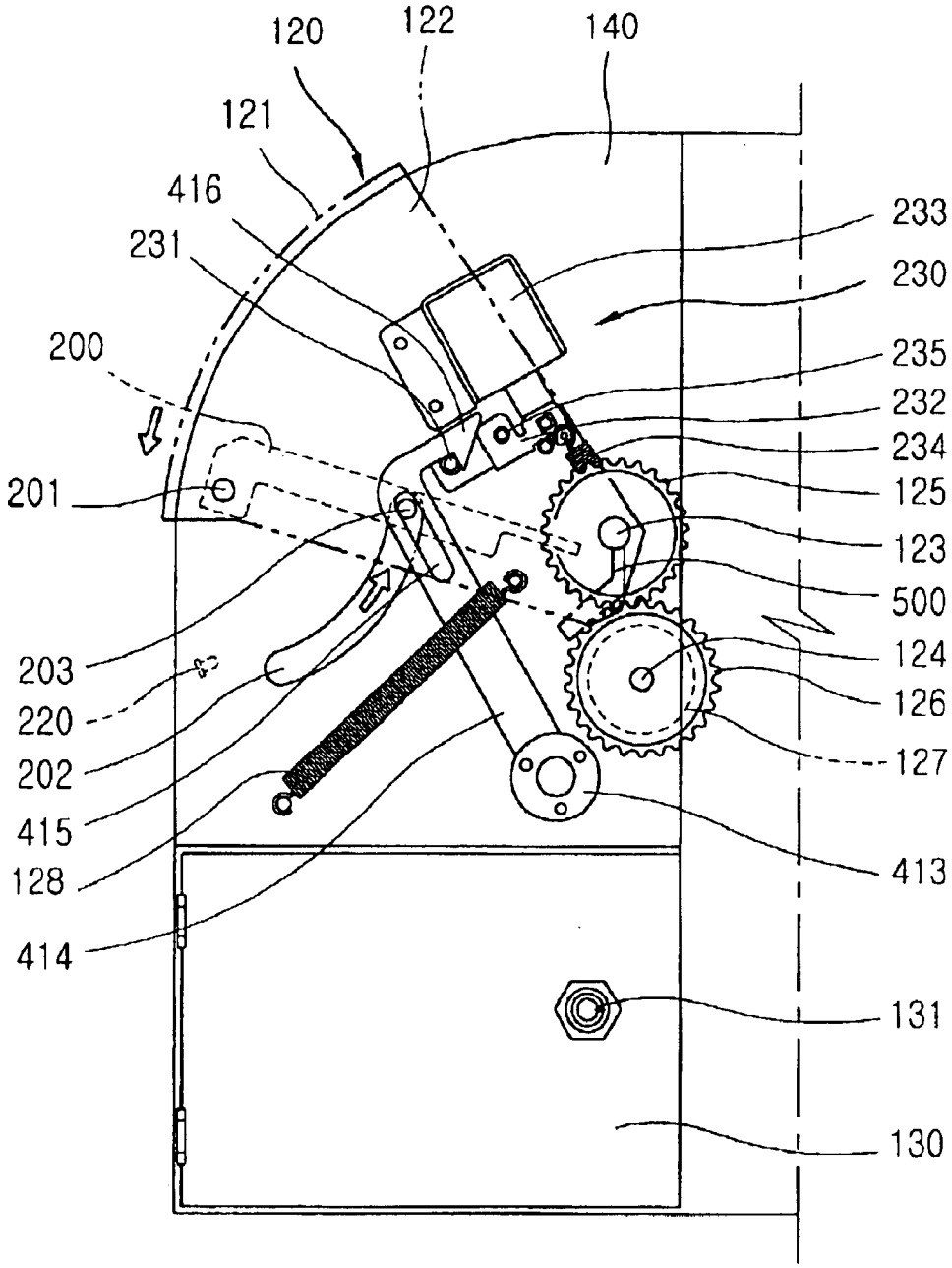
FIG. 6 is a view showing a state wherein the door of the media dispenser module of FIG. 1 is closed.

Meanwhile, in the operation procedure of the media dispenser apparatus, the controller 300 constantly senses whether the media dispenser apparatus is malfunction or not. If there is a malfunction signal during the media dispensing process, the controller checks whether there is media in the media mounting unit 200 through the media sensing unit 220. If there is media, as shown in FIG. 6, the door is maintained in a closing state so that the media may not be delivered to the user.

Figure 7:
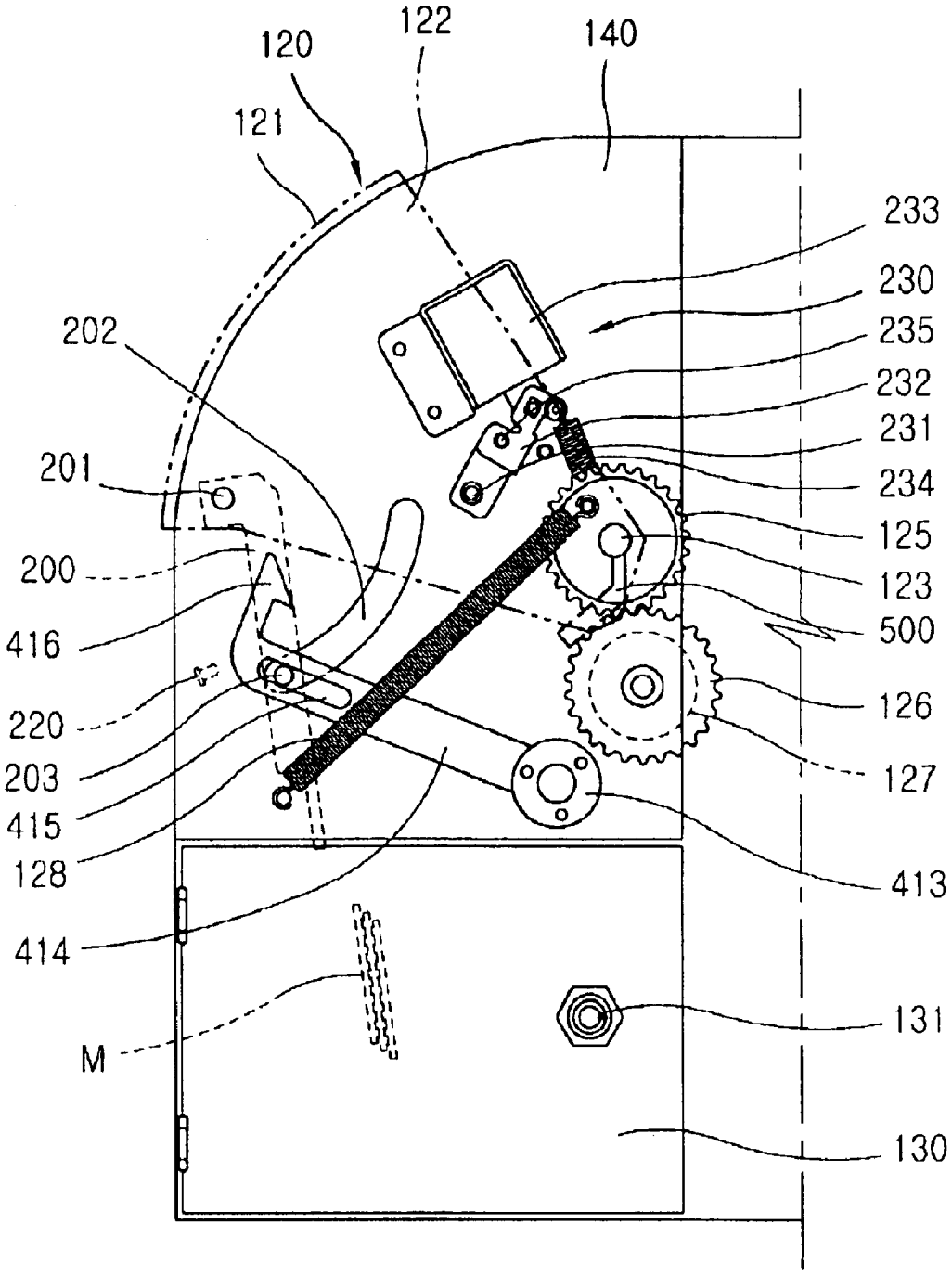
FIG. 7 is a view showing a state wherein a media mounting unit is placed at a second position after the door of the media dispenser module of FIG. 1 is closed.

As shown in FIG. 7, in order to retrieve the media on the media mounting unit 200, the controller 300 operates the moving unit 233 of the engagement releasing unit 230 to release engagement between the engaging hook 416 and the engaging pin 231 and at the same time operates the drive motor 211 of the driving unit 210 to rotate the media mounting unit 200 from the first position to the second position.

The media is dropped into the media retrieval box 130 according to rotation of the media mounting unit 200, and after a pre-set time elapses, the controller 300 rotates the media mounting unit 200 from the second position to the first position.

The controller 300 continuously checks whether there is media on the media mounting unit 200 by means of the media sensing unit 220. If it is checked that there is media on the media mounting unit 200, the media retrieval process is repeatedly performed. If, however, it is checked that there is no media, the media dispenser apparatus is in a standby state for a normal operation.

The controller 300 can separately inform a manager about a malfunction situation in addition to the media retrieval process according to the malfunction signal, or can record the malfunction content by using an additional record device.

Among malfunctions of the media dispenser apparatus, it may happen that the media remains on the media mounting unit 200 as the user may not wholly receive the media. In such a case, the controller repeatedly performs the above-described media retrieval process to retrieve the omitted media.

In other words, in the media dispensing process, if the user receives wholly the discharged media, the controller 300 closes the door 120 according to a signal as sensed by the media sensing unit 220 that there is no media after a pre-set time elapses. If the user receives a portion of the discharged media, the controller continuously receives a signal sensed by the media sensing unit 220 that there is a media, checks whether the pre-set time has elapsed, and closes the door 120 when the pre-set time elapses.

And then, in order to retrieve the media on the media mounting unit 200, the controller 300 operates the moving unit 233 of the engagement releasing unit 230 to release engagement between the engaging hook 416 and the engaging pin 231 and at the same time operates the drive motor 211 of the driving unit 210 to rotate the media mounting unit 200 from the first position to the second position.

Then, the media is dropped into the media retrieval box 130 according to rotation of the media mounting unit 200, and after a pre-set time elapses, the controller 300 rotates the media mounting unit 200 from the second position to the first position.

The controller 300 continuously checks whether there is a media on the media mounting unit 200 by means of the media sensing unit 220. If the controller 300 checks that there is a media, it repeatedly performs the above-described media retrieval process. If, however, the controller 300 checks that there is no media, it is in a standby state for a normal operation.

As so far described, if there occurs a remaining media at the media mounting unit as it is not drawn out for beyond a predetermined time due to a user's inadvertence, the media dispenser module retrieves the remaining media into the media retrieval box, rotates the media mounting unit to its original position and re-starts the media dispenser apparatus. Accordingly, time required for taking a suitable measure by the manager in occurrence of the remaining media is reduced, and thus, personnel expenses is reduced and the rate of operation of the machine can be improved.

If the door is opened, the media mounting unit is restrained by the movement restraining unit, not allowing the media mounting unit to be rotated intentionally. Therefore, the retrieved media collected in the media retrieval box when the door is opened is prevented from being stolen, so that its security is increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A media dispenser module comprising:

a casing mounted in a mounting unit of a media dispenser apparatus and having an opening accessible from outside and a door for opening and closing the opening;

a media mounting unit installed inside the casing and rotatable from a first position where media is maintained in a mounting state to a second position where the media is dropped and retrieved into a media retrieval box coupled to the casing;

a driving unit for moving the media mounting unit, the driving unit being composed of a drive motor fixedly installed at one side wall of the casing, a first gear coupled to a shaft of the drive motor, a second gear coupled to the first gear and coupled to a shaft which is fixedly installed at one side wall of the casing, a link member having a slot at one side thereof; and coupled to one side of the second gear, a guide slot formed at one side of the casing and a guide pin fixedly installed at one side of the media mounting unit and inserted into the guide slot and the link member slot;

a media sensing unit for sensing whether there is media on the media mounting unit; and a controller for controlling the opening and closing of the door and the driving unit according to a signal of the media sensing unit.

2. The module of claim 1, wherein if there is a malfunction signal of the media dispenser apparatus, the controller controls the media sensing unit to sense whether there is media, and rotates the media mounting unit from the first position to the second position to retrieve the media on the media mounting unit in a state where the door is in a closed state if there is media on the media mounting unit.

3. The module of claim 1, wherein when a pre-set time elapses in a state that there is media on the media mounting unit and the door is in the opened state, the controller controls to close the door and rotate the media mounting unit from the first position to the second position in order to retrieve the media on the media mounting unit into the media retrieval box.

4. The module of claim 1, wherein the door comprises:

an opening and closing unit for opening and closing the opening; and a pair of side portions formed to extend from each end of the opening and closing unit and rotatably hinged at an outer side of the side wall of the casing.

5. The module of claim 1, wherein both ends of the media mounting unit are coupled rotatably by a hinge shaft at an inner side of the side wall of the casing in the vicinity of the front side of the casing.

6. The module of claim 5, wherein the guide slot is formed as an arc centering around the hinge shaft, forming one end where the media mounting unit is placed at the first position and the other end where the media mounting unit is placed at the second position.

7. The module of claim 1, wherein a rotational shaft is installed at the same axial line with the shaft of the second gear of the driving unit, at the side wall opposite to the side wall where the driving unit is installed, and a rotational link with an auxiliary slot into which the guide pin is inserted is connected to the rotational shaft.

8. The module of claim 7, comprising:

an engaging hook formed at an end of the rotational link; and an engagement releasing unit having an engaging pin to which the engaging hook is engaged when the media mounting unit is placed at the first position.

9. The module of claim 8, wherein the engagement releasing unit releases engagement of the engaging hook by moving the engaging pin according to the operation signal of the controller.

10. The module of claim 9, wherein the engagement releasing unit comprises:

a rotational member having the engaging pin installed at its free end and rotatably centering around a shaft, and being installed at an outer side of the side wall of the casing;

a moving unit for moving the rotational member to allow the engaging hook to release engagement at the engaging pin; and an elastic member for restoring the rotational member to the engaging position.

11. The module of claim 1, wherein a position sensing unit is fixedly installed at an outer side of the side wall of the casing where the driving unit is installed to sense whether the media mounting unit is placed at the first position or at the second position.

12. The module of claim 7, wherein a movement restraining unit supporting the bottom of the media mounting unit placed at the first position is fixedly installed at the rotational shaft to which the side portion of the door and rotatable together with the door, in order to restrain the media mounting unit from moving when the door is in the opening position.

13. The module of claim 7, wherein when the door is in the closing position, the door does not interfere with the movement of the media mounting unit, and in order to restrain the media mounting unit from moving when the door is in the opening position, a movement restraining unit supporting the bottom of the media mounting unit placed at the first position is fixedly installed to be rotated together with the door at the rotational shaft to which the side portion of the door is coupled.

14. A media dispenser module comprising:

a mounting unit; and a media dispenser module having a casing mounted in a mounting unit of a media dispenser apparatus and having an opening accessible from outside and a door for opening and closing the opening; a media mounting unit installed inside the casing so that media is dropped from a first position where the media is maintained in a mounting state and rotated to a second position where the media is retrieved into a media retrieval box coupled to the casing; a driving unit for moving the media mounting unit, the driving unit being composed of a drive motor fixedly installed at one side wall of the casing, a first gear coupled to a shaft of the drive motor, a second gear coupled to the first gear and coupled to a shaft which is fixedly installed at one side wall of the casing, a link member having a slot at one side thereof and coupled to one side of the second gear, a guide slot formed at one side of the casing, and a guide pin fixedly installed at one side of the media mounting unit and inserted into the guide slot and the link member slot: a media sensing unit for sensing whether there is media on the media mounting unit; and a controller for controlling opening and closing of the door and the driving unit according to a signal of the media sensing unit.

15. A media dispenser module comprising a casing mounted in a mounting unit of a media dispenser apparatus and having an opening accessible from outside and a door for opening and closing the opening, an opening and closing unit for opening and closing the opening; a pair of side portions formed to extend from each end of the opening and closing unit and rotatably hinged at an outer side of the side wall of the casing, a media mounting unit installed inside the casing and being rotatable from a first position where media is maintained in a mounting state to a second position where the media is dropped and retrieved into a media retrieval box coupled to the casing;

a driving unit installed at the casing and moving the media mounting unit;

a media sensing unit for sensing whether there is media on the media mounting unit; and a controller for controlling the opening and closing of the door and the driving unit according to a signal of the media sensing unit.

16. A media dispensing module comprising a casing mounted in a mounting unit of a media dispenser apparatus and having an opening accessible from outside and a door for opening and closing the opening, a media mounting unit installed inside the casing and being rotatable from a first position where media is maintained in a mounting state to a second position where the media is dropped and retrieved into a media retrieval box coupled to the casing, wherein both ends of the media mounting unit are coupled rotatably by a hinge shaft at an inner side of the side wall of the casing in the vicinity of the front side of the casing, and a guide slot is formed at the side wall in the vicinity of the rear wall of the casing, and a guide pin is inserted into the guide slot to move along therein and coupled to the both ends of the media mounting unit;

a driving unit installed at the casing and moving the media mounting unit;

a media sensing unit for sensing whether there is media on the media mounting unit; and a controller for controlling the opening and closing of the door and the driving unit according to a signal of the media sensing unit.

17. A media dispenser module comprising:

a casing mounted in a mounting unit of a media dispenser apparatus and having an opening accessible from outside and a door for opening and closing the opening;

a media mounting unit installed inside the casing and being rotatable from a first position where a media is maintained in a mounting state to a second position where the media is dropped and retrieved into a media retrieval box coupled to the casing;

a driving unit installed at the casing and moving the media mounting unit said driving unit including a drive motor fixed to the side wall of the casing, a second gear rotated in mesh with a first gear coupled to a shaft of the drive motor; and a link member having a slot coupled to a shaft of the second gear, into which the guide pin is inserted.

* * * * *